US005465783A

United States Patent [19]

O'Connor

[11] Patent Number: 5,465,783

[45] Date of Patent: Nov. 14, 1995

[54] SACRIFICIAL EROSION BRIDGE FOR A HEAT EXCHANGER

[75] Inventor: Timothy J. O'Connor, North Tonawanda, N.Y.

[73] Assignee: FEDCO Automotive Components Company, Inc., Buffalo, N.Y.

[21] Appl. No.: 206,122

[22] Filed: Mar. 4, 1994

[51] Int. Cl.[6] ..... F28F 19/00

[52] U.S. Cl. ..... 165/134.1; 165/174

[58] Field of Search ..... 165/134.1, 153, 165/173, 174

[56] References Cited

U.S. PATENT DOCUMENTS

| | | | |
|---|---|---|---|
| 1,649,120 | 11/1927 | Kniskern | 165/174 |
| 2,513,124 | 6/1950 | Weiks | 165/174 X |
| 2,784,156 | 3/1957 | Maurin | 165/134.1 X |
| 2,914,012 | 11/1959 | Godfrey et al. | 165/134.1 X |
| 2,960,114 | 11/1960 | Hinde | 165/134.1 X |
| 3,697,191 | 10/1972 | Haymann | 415/168 |
| 4,254,825 | 3/1981 | Imazu | 165/134.1 X |
| 4,771,942 | 9/1988 | Arold et al. | 237/12.3 B |
| 5,186,249 | 2/1993 | Bhatti et al. | 165/174 |
| 5,238,059 | 8/1993 | Smith | 165/173 |
| 5,307,870 | 5/1994 | Kamiya et al. | 165/173 |

FOREIGN PATENT DOCUMENTS

| | | | |
|---|---|---|---|
| 151579 | 10/1981 | Germany | 165/134.1 |
| 1217196 | 8/1989 | Japan | 165/134.1 |

*Primary Examiner*—Martin P. Schwadron
*Assistant Examiner*—L. R. Leo
*Attorney, Agent, or Firm*—Gary M. Hartman; Domenica N. S. Hartman

[57] ABSTRACT

A method for reducing the internal erosion of a brazed aluminum heat exchanger, such as a heater core used in automotive applications. The heat exchanger is composed of a tank and header that form a chamber, a number of coolant tubes secured to the header such that ends of the tubes project into the chamber, and an inlet to the chamber disposed opposite to the tubes so as to direct a coolant toward the ends of the tubes. A sacrificial erosion member is brazed to the tank so as to be in the path of the coolant as the coolant flows from the inlet into the chamber, such that the coolant impinges the erosion member as it enters the chamber. As a result, the coolant is deflected away from the ends of the tube so as to reduce erosion of the ends of the tubes. Furthermore, the erosion member serves to enhance the efficiency of the heat exchanger by improving the flow distribution of the coolant among the tubes.

16 Claims, 3 Drawing Sheets

SACRIFICIAL EROSION BRIDGE FOR A HEAT EXCHANGER

The present invention relates to heat exchangers, and particularly those of the type used as heater cores in automobile heating systems. More particularly, this invention relates to an improved monolithic aluminum heat exchanger whose service life is extended by the inclusion of a sacrificial member that significantly reduces the tendency for erosion within the heat exchanger, and more particularly reduces the amount of erosion which occurs at the ends of the heat exchanger's coolant tubes.

BACKGROUND OF THE INVENTION

Heat exchangers are employed within the automotive industry as radiators which cool the engine coolant, condensers and evaporators for use in air conditioning systems, and heater cores. In order to efficiently maximize the amount of surface area available for transferring heat between the environment and a fluid flowing through the heat exchanger, the design of the heat exchanger is typically of a tube-and-fin type in which numerous tubes thermally communicate with high surface area fins. The fins enhance the ability of the heat exchanger to transfer heat from the fluid to the environment, or vice versa. For example, heat exchangers used in the automotive industry as heater cores serve to transfer heat from the engine coolant to the air entering the passenger compartment.

Heat exchangers are increasingly being formed by a brazing operation in which the individual components of the heat exchanger are permanently joined together with a brazing alloy. Generally, brazed heat exchangers are lower in weight and are better able to radiate heat as compared to heat exchangers formed by known mechanical assembly techniques. An example of a brazed heat exchanger is the headered tube-and-center (HTC) type, which utilizes a number of parallel tubes which are brazed to and between a pair of headers, with finned centers being brazed between each adjacent pair of tubes. Conventionally, headered tube-and-center heat exchangers have been constructed by inserting the parallel tubes into apertures formed in each of an opposing pair of headers. A finned center is then positioned between each adjacent pair of parallel tubes. A tank is attached to each header so as to form reservoirs which are in fluidic communication with the tubes through the apertures. One or both tanks include one or more ports which serve as an inlet and outlet to the heat exchanger.

In the automotive industry, copper and brass heater cores which were widely used in the past have largely been replaced by aluminum heater cores in order to reduce the weight of automobiles. To minimize weight, many heater cores are formed to have plastic tanks and aluminum tubes, headers and fins, necessitating that the tanks be bonded to a brazed assembly formed by the headers, tubes and fins. Others are formed entirely from aluminum alloys, enabling the entire heater core to be joined in a single operation. A serious problem with these types of heater cores is that the brazing operation significantly softens the aluminum alloy or alloys which form the heater core. Consequently, an aluminum alloy heater core is subject to shorter service life from erosion of its internal surfaces, especially when solid contaminants are suspended in the coolant, as is often the case.

Erosion particularly occurs due to the coolant directly impinging the ends of the tubes of a headered tube-and-center heater core as it flows into the heater core through the inlet, causing significant erosion of the metal and premature deterioration of the heater core. Furthermore, the performance of the heater core is impaired because the flow distribution of the coolant among the tubes is not uniform, with the tubes closest the inlet handling the majority of coolant flow through the heater core.

The prior art has sought to overcome the abovenoted erosion problem by increasing the wall thickness of the coolant tubes. However, doing so is undesirable in that it increases the weight of the heater core and complicates its manufacture and assembly. For heater cores with plastic tanks, the prior art has also attempted to solve the erosion problem by ultrasonically welding a plastic baffle downstream of the heater core inlet in order to deflect the coolant away from the tube ends. However, this solution undesirably requires an additional assembly and joining step in order to position and ultrasonically weld the baffle to the tank prior to bonding the tank to the header. Furthermore, plastic baffles are not feasible for heater cores formed entirely from aluminum. Manufacturers of all-aluminum heater cores have not sought a solution similar to the plastic baffle of the prior art in that an aluminum baffle would require being welded in place prior to brazing, which would be undesirable and costly from a processing standpoint. In addition, the welding operation might result in warpage or distortion of the components, which would seriously impede the assembly and fixturing of the components for brazing. Finally, high warranty and/or replacement costs would result if the weld were to fail, allowing the baffle to rattle within the heater core.

Consequently, the use of a flow restrictor placed upstream of the inlet to an all-aluminum heater core has been proposed in order to reduce the flow rate through the heater core which, in turn, reduces the tendency for the coolant to erode the ends of the coolant tubes. However, the performance of a heater core can be significantly compromised at reduced flow rates, which in practice have been as little as five gallons per minute or less. Others have suggested mounting the inlet pipe to the side of the tank in order to avoid impinging the inlet flow directly on the coolant tubes. However, this approach typically requires the formation of complex and, therefore, costly bends in the inlet pipe. Furthermore, the space available in a vehicle typically dictates the placement of the inlet and outlet pipes, and will often prevent locating the inlet pipe to the side of the tank. Yet others have suggested increasing the diameter of the inlet pipe in order to reduce the coolant velocity as the coolant enters the heater core. Again, however, the available space in a vehicle may not allow the use of larger diameter pipes. In addition, larger diameter pipes are more costly and necessitate a bend radius which is greater than that possible for a smaller diameter tube. Consequently, the installation of a larger diameter pipe may be complicated or infeasible for a particular application.

From the above, it is apparent that the prior art lacks a suitable solution to the problem of coolant tube erosion in an all-aluminum heat exchanger such as those used as an automotive heater core. Accordingly, it would be desirable to provide an all-aluminum monolithic heat exchanger which is characterized by significantly reduced internal erosion, particularly at the ends of the coolant tubes immediately downstream of the heat exchanger inlet, without reducing the flow capacity of the heat exchanger and without complicating the assembly and installation of the heat exchanger. Furthermore, it would be desirable if such a heat exchanger could be readily formed using a single brazing operation, so as to facilitate its manufacture. It would also be desirable if the efficiency of such a heat exchanger could simultaneously be enhanced by improving the flow distribution of the coolant among the coolant tubes.

SUMMARY OF THE INVENTION

It is an object of this invention to provide an aluminum monolithic heat exchanger whose construction and assembly requirements are suitable for automotive applications, such as a heater core.

It is another object of this invention that such a heat exchanger be constructed so as to enable the heat exchanger to be joined in a single brazing operation.

It is yet another object of this invention that such a heat exchanger be equipped with a sacrificial erosion member which significantly reduces the erosion of the internal surfaces of the heat exchanger in order to increase the service life of the heat exchanger.

It is a further object of this invention that the structure of the heat exchanger be such that the flow distribution through the heat exchanger is significantly improved, so as to enhance the performance and efficiency of the heat exchanger.

It is yet a further object of this invention that the flow capacity of the heat exchanger be sufficient to substantially prevent the creation of back pressure upstream of the heat exchanger.

In accordance with a preferred embodiment of this invention, these and other objects and advantages are accomplished as follows.

According to the present invention, there is provided a method for reducing the internal erosion of a aluminum monolithic heat exchanger, such as a heater core used in automotive applications. Such heat exchangers are typically composed of a pair of tanks and headers that form a corresponding pair of chambers, a number of coolant tubes secured to each of the headers such that both ends of the tubes project into the chambers, and an inlet to one of the chambers. The inlet is disposed opposite to the tubes such that a coolant flowing into the heat exchanger through the inlet is directed toward the ends of the tubes. The method of this invention generally includes brazing a sacrificial erosion member to the tank equipped with the inlet, such that the erosion member is in the path of the coolant as it flows from the inlet into the chamber. As a result, the coolant impinges the erosion member as it enters the chamber, and is deflected from the ends of the tube so as to reduce erosion of the ends of the tubes.

A heat exchanger formed in accordance with this invention is preferably composed of aluminum alloy components, including the tanks, headers, tubes and the sacrificial erosion member. These components are brazed together during a single brazing operation to form a monolithic heat exchanger assembly. The erosion member is brazed to the tank so as to be disposed within the chamber immediately downstream of the inlet. The erosion member preferably serves to divert the flow of the coolant into at least two flow paths upon impinging the erosion member, so as to improve the flow distribution for the coolant among the coolant tubes. Furthermore, the erosion member is preferably spaced apart from the inlet of the tank such that the cross-sectional flow area defined by the erosion member is at least equal to that of the inlet. The erosion member may be any of numerous forms, including a plate having a pair of resilient members which can be resiliently biased against an inner surface of the tank during assembly prior to brazing. The erosion member can also be integrally formed with an inlet member which forms the inlet to the heat exchanger.

From the above, it can be seen that a significant advantage of this invention is that an all-aluminum monolithic heat exchanger can be readily formed in accordance with this invention to include an erosion member which is capable of substantially increasing the service life of the heat exchanger. In particular, erosion caused by coolant flowing through the heat exchanger will largely be sustained by the erosion member, instead of the ends of the coolant tubes. The erosion member can also be configured to improve the distribution of the coolant to the tubes, such that the efficiency and performance of the heat exchanger can be significantly enhanced.

The erosion member of this invention is particularly suited for use in a monolithic heat exchanger, in that it can be brazed in place during the single braze operation in which each of the heat exchanger's components are brazed together. As a result, the assembly and joining of the heat exchanger is not significantly complicated by utilizing the erosion member of this invention. Furthermore, the erosion member can be adapted to further facilitate assembly of the heat exchanger. For example, the erosion member can be equipped with a pair of resilient members in order to easily secure the erosion member within the tank or between the tank and header during assembly, such that additional fixturing to secure the erosion member in place is unnecessary. Alternatively, the erosion member can be formed as an integral portion of an inlet member which forms the inlet through the tank wall into the heat exchanger.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings wherein.

DETAILED DESCRIPTION OF THE INVENTION

Figure 1:
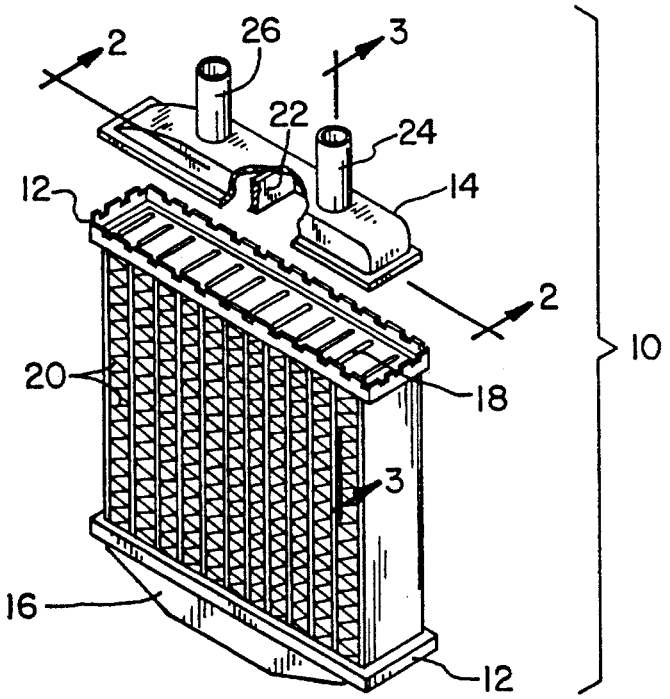
FIG. 1 illustrates a perspective view of a headered tube-and-center type heater core unit.

Shown in FIG. 1 is a headered tube-and-center type heater core 10 which can be formed in accordance with this invention. The tube-and-center design is preferred for heat exchangers used in automotive applications, such as the heater core 10 shown, because the design maximizes the amount of surface area that is in contact with incoming air. The air is forced around the high surface area provided by finned centers 20 located between adjacent pairs of pipes or tubes 18, providing for a high heat exchange rate between the air and a suitable fluid which flows through the tubes 18. The tubes 18 are oriented to be geometrically in parallel with each other, as well as hydraulically in parallel, between a pair of headers 12. The end of each tube 18 is received within a corresponding aperture formed in each of the headers 12.

As illustrated, an inlet/outlet tank 14 is assembled to one of the headers 12, while a return tank 16 is assembled to the other header 12. The inlet/outlet tank 14 is equipped with an inlet 24 and an outlet 26 through which a suitable coolant is delivered to and from the heater core 10. As is conventional, the tanks 14 and 16 define reservoirs, with the inlet/outlet tank 14 being divided with a pass partition 22 such that the coolant is forced to flow through one bank of tubes 18 to the return tank 16, after which the coolant flows through the remaining tubes 18, back to the inlet/outlet tank 14, and out through the outlet 26.

Most preferably, the entire heater core assembly 10 is brazed together in a single brazing operation in order to facilitate the manufacture of the heater core 10. Consequently, each of the components described above are preferably formed from a suitable aluminum alloy, such as aluminum alloy AA 3003, as designated by the Aluminum Association (AA), though other similar aluminum alloys could also be employed. To further facilitate assembly and brazing, the headers 12 and tubes 18 are preferably formed from an aluminum alloy, such as AA 3003, which is clad with a suitable braze alloy, such as aluminum-silicon eutectic brazing alloys AA 4045, AA 4047 and AA 4343. Alternately, the tank 14 and/or finned centers 20 could be formed from a clad aluminum alloy material in addition to or instead of the headers 12 and tubes 18. The braze alloy cladding has a lower melting temperature than the core material, and therefore serves to form the brazements during the brazing operation. In addition to an outer clad layer, each tube 18 preferably has an inside liner composed of a suitable aluminum alloy, such as AA 1350.

Generally speaking, aluminum alloy AA 3003 has been found to perform satisfactorily and can be easily formed to produce the headers 12, tanks 14 and 16, and tubes 18, as well as the finned centers 20. In addition, there are no inherent brazing difficulties associated with the use of this particular alloy, and the structural integrity of the material during use has generally been found to be sufficient. However, other aluminum alloys are known and used in the art, and the scope of this invention is not to be interpreted as being limited to the alloys noted above.

Furthermore, while the above type of heat exchanger is particularly suited for the teachings of the present invention, numerous variations on the structure shown in FIG. 1 are known in the art, with numerous additional variations being foreseeable. Accordingly, the teachings of this invention are not to be construed as being limited to the monolithic headered tube-and-center heater core 10 shown in the Figures.

Figure 2:
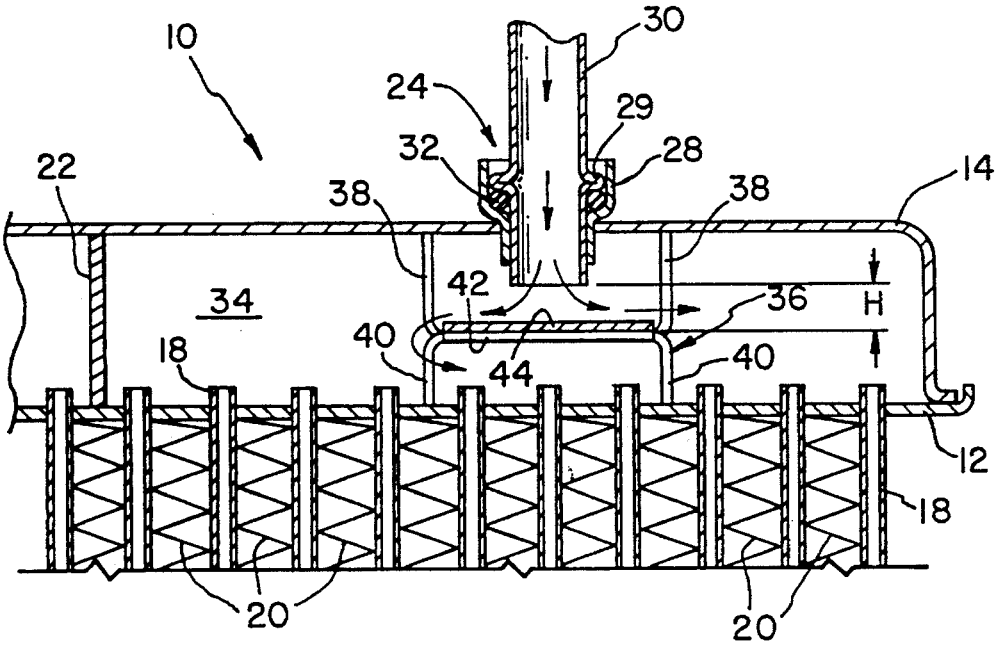
FIG. 2 is a partial cross-sectional view of the heater core of FIG. 1 along line 2—2, showing a sacrificial erosion member in accordance with a first embodiment of this invention.

Shown in greater detail in FIG. 2 is a partial cross-sectional view of the heater core 10 after brazing in accordance with a first embodiment of this invention. As illustrated, the heater core 10 includes a sacrificial erosion bridge 36 disposed within a reservoir 34 formed by the inlet/outlet tank 14 and its corresponding header 12. The erosion bridge 36 is positioned immediately downstream of the inlet 24 formed by an inlet cup 28 and inlet pipe 30. The inlet cup 28 and inlet pipe 30 can be formed and assembled in a generally conventional manner. FIG. 2 depicts the inlet cup 28 is being brazed to the tank 14, while the inlet pipe 30 is formed with a peripheral flange 29 that engages an O-ring 32 disposed in the inlet cup 28 in order to form a fluid-tight seal. As shown, the end of the inlet pipe 30 extends into the reservoir 34 and defines the inlet opening into the heater core 10. While the use of cups for both inlet and outlet pipes 24 and 26 is conventional and well known in the art, it is also conventional to braze the inlet and outlet pipes 24 and 26 directly to the tank 14 without the use of a cup 28. Therefore, this invention is not to be interpreted as being limited to heater cores which use the inlet cup 28 shown in FIG. 2.

The erosion bridge 36 illustrated in FIG. 2 is generally composed of a sacrificial plate 42 supported by one or more upper legs 38 and one or more lower legs 40. In order to facilitate the implementation of this invention with the assembly and brazing of the heater core 10, the erosion bridge 36 is preferably formed from an aluminum alloy core material which is clad with a braze alloy, as discussed above for the conventional components of the heater core 10. The upper legs 38 engage the inner surface of the tank 14 opposite the header 12, while the lower legs 40 engage the surface of the header 12 between adjacent pairs of tubes 18. The length of the upper and lower legs 38 and 40 can be selected to create a slight interference between the erosion bridge 36 and the tank 14 and header 12 during assembly, such that the erosion bridge 36 will be secured in place prior to and throughout the brazing operation. Alternatively, recesses can be formed in the surfaces of the tank 14 and header 12 in order to capture and secure the ends of the upper and lower legs 38 and 40.

The plate 42 is generally planar, and spaced a predetermined distance from the inlet formed by the inlet pipe 30. More particularly, in order to prevent the creation of back pressure during the operation, the plate 42 is spaced apart from the end of the inlet pipe 30 such that the cross-sectional flow area defined by the erosion bridge 36, i.e., between the plate 42 and the end of the inlet pipe 30, is at least equal to that of the inlet pipe 30. For example, a round inlet pipe 30 having a diameter "D" would have a cross-sectional flow area $\pi D/4$, necessitating that the cross-sectional flow area between the plate 36 and the end of the inlet pipe 30 be at least $\pi DH$, where H is the distance between the plate 36 and the inlet pipe 30, as indicated in FIG. 2.

Figure 3:
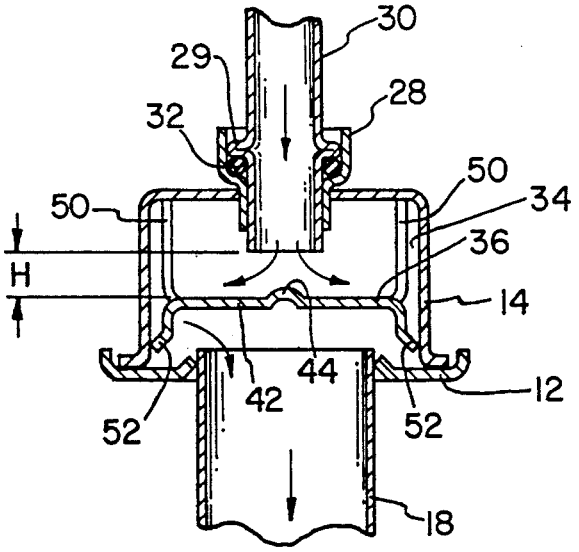
FIG. 3 is a cross-sectional view of the heater core of FIG. 1 along line 3—3, showing a sacrificial erosion member in accordance with a second embodiment of this invention.

The preferred width and length of the plate 42 may vary for different applications and conditions. Generally, however, the plate 42 preferably extends substantially the full width of the tank 14 (as indicated by the embodiment of FIG. 3), and the length of the plate 42 should be sufficient to accommodate the full width of the incoming fluid column, as shown in FIG. 2. By forming the plate 42 to have a length which exceeds the width of the incoming fluid column, the placement tolerance of the plate 42 within the tank 14 relative to the inlet pipe 30 can be readily taken into account. As illustrated in FIG. 2, the plate 42 enables the flow of the coolant to be more uniformly distributed among those tubes 18 which deliver the coolant to the return tank 16. To further enhance the distribution characteristics of the plate 42, a flow diverter 44 is preferably formed on its surface in order to divert the flow of the coolant into at least two flow paths. The flow diverter 44 may be a single dimple located centrally on the plate 42, or one or more ribs which form flow passages on the surface of the plate 42. Forming the flow diverter 44 as a rib is advantageous in that a flow diverter 44 formed as a dimple would complicate assembly by requiring the dimple to be precisely placed directly below the inlet pipe 30 in order to perform as intended. As shown in FIG. 2, the flow diverter 44 is a rib oriented to be parallel to the row of tubes 18, such that the flow of the incoming coolant is divided into two paths, each of which is directed toward one side of the tank 14. As a general rule, it is believed that the height of the flow diverter 44 above the surface of the plate 42 should be no greater than about half the radius of the inside diameter of the inlet pipe 30.

During the assembly of the heater core 10, a predetermined amount of flux compound is deposited prior to the brazing operation in an amount sufficient to deoxidize and wet the surfaces to be joined, as is known in the art. Typically, the flux is applied to the external surfaces of the heater core 10 to promote the external formation of braze fillets between the headers 12, tanks 14 and 16, tubes 18 and finned centers 20 during brazing. In accordance with this invention, flux is also applied to the internal surfaces of the tank 14 and the header 12 in order to braze the erosion bridge 36 to the tank 14 and header 12. As is conventional, once the flux has been appropriately applied to the heater core 10 and the components of the heater core 10 are appropriately fixtured in place, the furnace brazing operation is performed at a temperature which is sufficient to melt the flux and the braze alloy cladding material. Once melted, the flux removes the oxide ordinarily present on the exposed aluminum surfaces, promotes flow of the molten brazing alloy, and inhibits further oxide formation. Most preferably, and as generally practiced in the prior art, the brazing furnace maintains an atmosphere which discourages further oxidation of the heater core 10 in that it contains a minimal amount of oxygen and moisture. Upon cooling, the molten brazing alloy solidifies to form the numerous brazements which seal the joints and bond the components together. The result is leak-free joints between each of the components, resulting in a monolithic brazed heat exchanger such as that illustrated in FIG. 1.

FIG. 3 illustrates an erosion bridge 36 in accordance with a second embodiment of this invention. As with the embodiment shown in FIG. 2, the erosion bridge 36 of the second embodiment includes a sacrificial plate 12 which is provided with a flow diverter 44 in the form of a rib. As before, the rib is oriented to be parallel to the row of tubes 18, such that the flow of the incoming coolant is divided into two paths, each of which is directed toward one side of the tank 14. The erosion bridge 36 of this embodiment differs from that shown in FIG. 2 primarily by the manner in which the plate 42 is located within the reservoir 34. The plate 42 is supported by a pair of upper legs in the form of hold-off tabs 50, and a pair of lower legs in the form of springback tabs 52, each of which is formed from a clad aluminum alloy material as described previously. The hold-off tabs 50 serve to space the plate 42 a predetermined distance H from the inlet pipe 30, for the purpose described above, while the springback tabs 52 serve to secure the erosion bridge 36 to the tank 14 by resiliently engaging the sides of the tank 14, as shown. Accordingly, an unbrazed subassembly can be formed with the erosion bridge 36 and the tank 14 by gently forcing the erosion bridge 36 into the interior of the tank 14 prior to assembling and fixturing the heater core 10 for brazing. Because this step can be preformed off-line, the sacrificial bridge 36 of this embodiment significantly simplifies the assembly procedure for the heater core 10. To permanently secure the erosion bridge 36 to the tank 14, the ends of the hold-off tabs 50 and springback tabs 52 are brazed to the inner surface of the tank 14 during the single brazing operation in which the entire heater core 10 is brazed.

Figure 4:
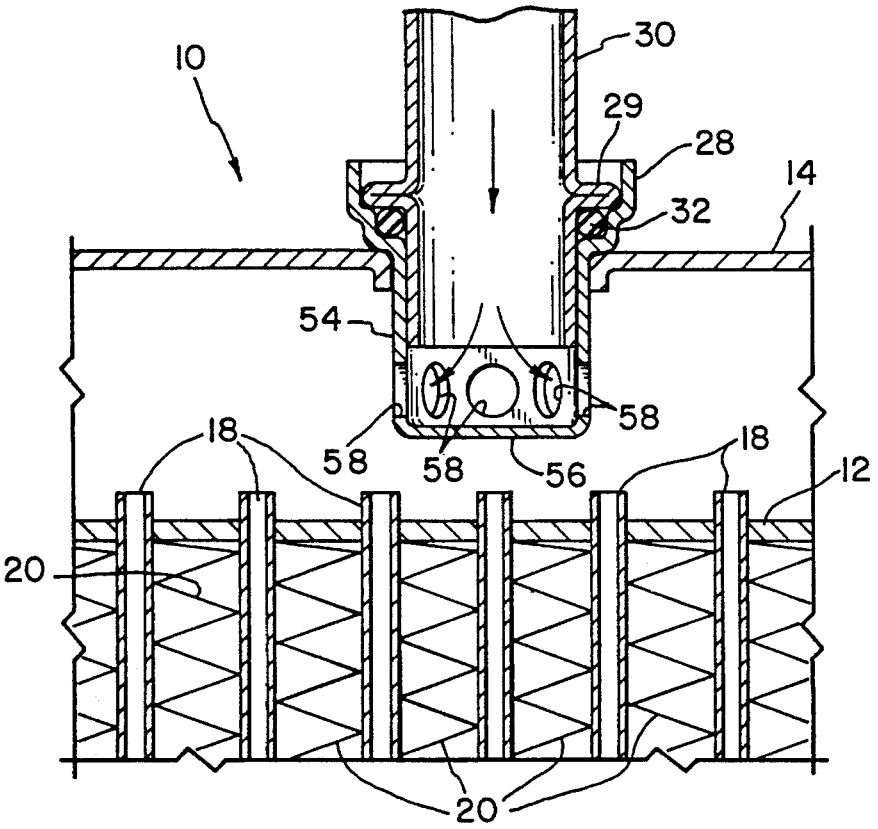
FIGS. 4 and 5 are cross-sectional views of the heat exchanger of FIG. 1 in accordance with third and fourth embodiments of this invention.

A third embodiment of this invention is shown in FIG. 4, which illustrates an erosion bridge that is formed to be integral with an inlet cup 54. The inlet cup 54 receives the inlet pipe 30 in much the same manner as before. However, contrary to the embodiments of FIGS. 2 and 3, the inlet cup 54 extends beyond the end of the inlet pipe 30, and terminates with a closed end 56. A number of holes 58 are formed through the circumferential wall of the inlet cup 54 immediately above of the closed end 56, and provide passages through which the coolant enters the reservoir 34. Consequently, the closed end 56 of the inlet cup 54 primarily forms the erosion bridge of this invention, and performs the same function as those described for FIGS. 2 and 3, in that the coolant is prevented from impinging directly on the ends of the tubes 18 in order to minimize erosion. Generally, the closed end 56 forms a sacrificial plate which is integral with the inlet cup 54, and therefore simplifies the assembly and brazing procedure by eliminating the requirement to position, secure and braze a separate member to the tank 14 in order to provide erosion protection for the tubes 18.

Importantly, the holes 58 are sized such that their combined cross-sectional areas are equivalent to at least that of the inlet pipe 30 in order to avoid the creation of back pressure upstream of the heater core 10. Most preferably, the holes 58 are slightly oversized in order to compensate for losses incurred due to the sharp turn through which the coolant must flow as it passes through the inlet pipe 30 and holes 58 before entering the reservoir 34. Furthermore, the distribution and relative sizes of the holes 58 can be varied along the circumference of the inlet cup 54 in order to achieve a particular flow distribution among the tubes 18 and within the reservoir 34.

Figure 5:
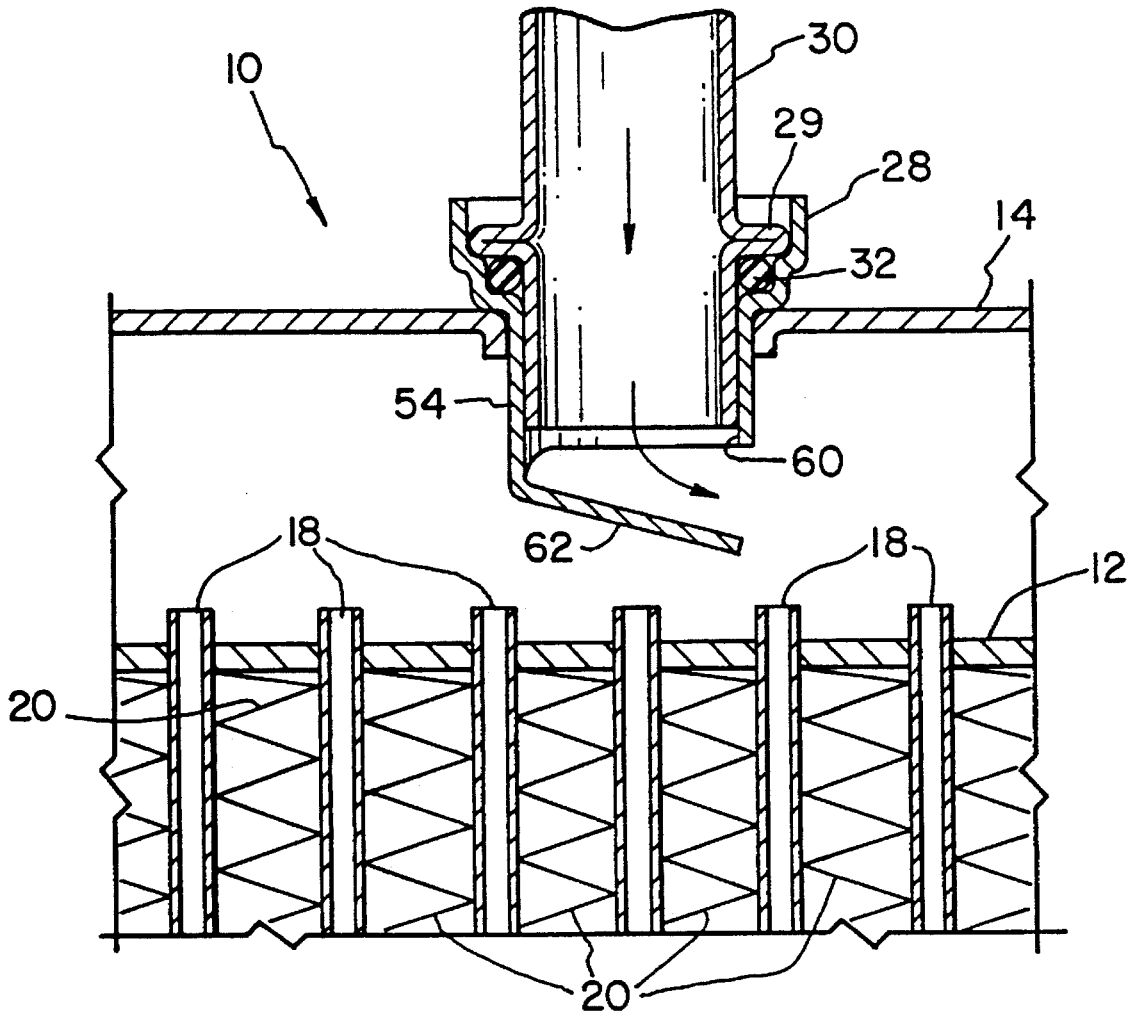

A variation of the third embodiment of this invention is illustrated in FIG. 5, in which the inlet cup 54 is modified as shown. The inlet cup 54 of this embodiment is made more readily manufacturable by eliminating the holes 58 and, instead, forming an angled flap 62 which is pierced from the end of the inlet cup 54 to form an opening 60. The flap 62 serves as an erosion bridge which is again formed to be integral with the inlet cup 54, and prevents the coolant from impinging directly on the ends of the tubes 18 in order to minimize erosion. As before, this configuration simplifies the assembly and brazing procedure for the heater core 10 by eliminating the requirement to position, secure and braze a separate member to the tank 14 in order to provide erosion protection for the tubes 18. The flow area through the opening 62 is sized such that its cross-sectional area is at least that of the inlet pipe 30 in order to avoid the creation of back pressure upstream of the heater core 10. Those skilled in the art will recognize that the flow area through the opening 60 can be altered by varying the angle of the angled flap 62 relative to the end of the inlet pipe 30. Furthermore, the inlet cup 54 shown in FIG. 5 could be modified to include two or more angled flaps 62 formed along the perimeter of the end of the inlet cup 54. As such, each flap 62 would form a flow passage for the coolant, and thereby duplicate the advantages attainable by the embodiment of FIG. 5, in that a more uniform flow distribution of the coolant could be achieved among the tubes 18.

From the above, it can be seen that a particularly advantageous feature of this invention is that an all-aluminum monolithic heat exchanger can be readily assembled in accordance with this invention to include a sacrificial erosion member which is capable of substantially increasing the service life of the heat exchanger. In particular, erosion which would otherwise result from coolant impinging directly on the ends of the coolant tubes 18 is primarily sustained by an erosion bridge 36 brazed between the tank 14 and the header 12, or by a surface integrally formed with the inlet cup 54. Because erosion of the ends of the tubes 18 is significantly reduced, the tubes 18 can be formed from a tube stock material having a wall thickness of less than about 0.014 inch (about 0.35 millimeter), resulting in a significantly lower weight for the heat exchanger. Consequently, this invention is particularly suited for heater cores used in automotive applications which are particularly susceptible to erosion due to solid contaminants which are often suspended in the coolant. In addition, because a heater core formed in accordance with this invention can achieve the desired benefits with a standard-sized inlet pipe 30 that is aligned with and connected to the tank 14 in a conventional manner, the heater core is more readily able to be accommodated within the limited space typically available in an automobile.

Advantageously, the erosion members of this invention also serve to improve the distribution of the coolant to the tubes 18, such that the efficiency and performance of the heat exchanger can be significantly enhanced. In particular, the flow path of the coolant can be divided into two or more paths by the erosion member, and these flow paths can be preselected in order to optimize the flow characteristics of the coolant through the heat exchanger. Notably, the flow characteristics of the heat exchanger are also optimized because the prior art use of a flow restrictor upstream of the heat exchanger in order to reduce internal erosion of a heat exchanger is made obsolete by the teachings of this invention.

Furthermore, the erosion members of the present invention are particularly suited for use in monolithic heat exchangers, in that each can be brazed in place during the single brazing operation in which the headers 12, tanks 14 and 16, tubes 18 and finned centers 20 are brazed together. Consequently, joining operations prior to the brazing operation are not required to practice this invention. Most preferably, the erosion members are formed from an aluminum alloy core material which is clad with a braze alloy, such that during the brazing operation the braze alloy cladding will form the brazements required to permanently secure the erosion member within the heat exchanger.

Another advantageous feature of this invention is that assembly of the heat exchanger is further facilitated by the various configurations in which the erosion member can be formed. For example, the erosion member may be a bridge which is either captured between the header 12 and tank 14, or equipped with a pair of springback tabs 52 in order to be readily secured within the tank 14 prior to final assembly, such that additional fixturing to secure the erosion member in place is unnecessary. Alternatively, the erosion member can be formed as an integral portion of the inlet cup 54, which in turn is brazed to the tank 14 to form an inlet through the tank wall into the heat exchanger. Consequently, the implementation of the erosion members of this invention does not significantly complicate the assembly and joining of the heat exchanger, enabling the heat exchanger to be suitable for manufacturing and use in the automotive industry.

While our invention has been described in terms of a preferred embodiment, it is apparent that other forms could be adopted by one skilled in the art. For example, materials, processes and procedures other than those noted above could be adopted, the heat exchanger design could be modified considerably, and other adaptations of the erosion members shown in the Figures could be devised by those skilled in the art. Accordingly, the scope of our invention is to be limited only by the following claims.

The embodiments of the invention in which an exclusive property or privilege is claimed are defined as follows:

1. A heat exchanger comprising:

an aluminum alloy tank member having an inlet through which a coolant flows into the heat exchanger;

a header attached to the tank member so as to form a chamber therewith, the header having a plurality of apertures formed therein;

a plurality of tubes received in the apertures of the header such that an end of each of the tubes projects into the chamber formed by the tank member and the header; and an aluminum alloy sacrificial erosion member brazed to the tank member so as to be disposed within the chamber downstream of the inlet, such that the coolant entering the heat exchanger through the inlet impinges the sacrificial erosion member and is thereby deflected away from the ends of the tubes, so as to reduce erosion of the ends of the tubes, the sacrificial erosion member having a first support member and an oppositely disposed second support member, the first support member engaging the tank member and spacing the sacrificial erosion member from the tank member, the second support member spacing the sacrificial erosion member from the header, the first and second support members cooperating to immobilize the sacrificial erosion member within the chamber.

2. A heat exchanger as recited in claim 1 wherein the sacrificial erosion member has a means for diverting the flow of the coolant into at least two flow paths upon impinging the sacrificial erosion member.

3. A heat exchanger as recited in claim 1 wherein the sacrificial erosion member is spaced apart from the inlet of the tank member such that the cross-sectional flow area defined by the sacrificial erosion member is at least equal to that of the inlet.

4. A heat exchanger as recited in claim 1 wherein the sacrificial erosion member comprises a plate which is supported between the tank member and the header with the first and second support members.

5. A heat exchanger as recited in claim 1 wherein the second support member comprises a pair of resilient members which are resiliently biased against and brazed to an inner surface of the tank member.

6. A heat exchanger as recited in claim 1 wherein the sacrificial erosion member is clad with a braze alloy for brazing the sacrificial erosion member to the tank member.

7. A heat exchanger as recited in claim 1 wherein the header and the tubes are formed from aluminum alloys, and wherein the header is brazed to the tank member and the tubes are brazed to the header.

8. A heat exchanger as recited in claim 1 wherein the heat exchanger is a monolithic heat exchanger.

9. A method for reducing erosion within a heat exchanger having a tank and header that form a chamber, a plurality of tubes secured to the header such that ends of the tubes project into the chamber, and an inlet to the chamber disposed opposite to the tubes so as to direct a coolant toward the ends of the tubes, the method comprising the steps of:

forming a sacrificial erosion member having a first support member and an oppositely disposed second support member;

positioning the sacrificial erosion member within the tank such that the first support member spaces the sacrificial erosion member from the tank and such that the second support member shall space the sacrificial erosion member from the header when assembled with the tank, the first and second support members cooperating to immobilize the sacrificial erosion member within the chamber such that the sacrificial erosion member is positioned in the flow path of the coolant as the coolant flows from the inlet into the chamber, and such that the coolant impinges the sacrificial erosion member and is thereby deflected away from the ends of the tube so as to reduce erosion of the ends of the tubes; and brazing the sacrificial erosion member to the tank.

10. A method as recited in claim 9 wherein the step of brazing occurs during a single brazing operation in which the tank, header, tubes and sacrificial erosion member are brazed together to form a monolithic heat exchanger.

11. A method as recited in claim 9 wherein the positioning step comprises resiliently engaging the second support member with the tank prior to the brazing step.

12. A method as recited in claim 9 further comprising the step of forming a flow diverter on the sacrificial erosion member for diverting the flow of the coolant into at least two flow paths upon impinging the sacrificial erosion member.

13. A method as recited in claim 9 further comprising the step of brazing the sacrificial erosion member to the header.

14. A method as recited in claim 9 further comprising the step of spacing the sacrificial erosion member from the inlet of the tank such that the cross-sectional flow area defined by the sacrificial erosion member is at least equal to that of the inlet.

15. A method for reducing erosion within an automobile heater core, the method comprising the steps of:

forming a tank, a header, a plurality of tubes and a sacrificial erosion member from an aluminum alloy, the tank having an inlet formed therein, the sacrificial erosion member having a first support member and an oppositely disposed second support member;

assembling the tank, the header, the tubes and the sacrificial erosion member so as to form the heater core, wherein the tank and the header form a chamber and ends of the tubes project into the chamber through apertures in the header, such that coolant flowing into the chamber through the inlet is directed toward the ends of the tubes, and wherein the sacrificial erosion member is disposed downstream of the inlet so as to be in the path of the coolant as the coolant flows from the inlet into the chamber, such that the coolant impinges the sacrificial erosion member and is thereby deflected away from the ends of the tube, so as to reduce erosion of the ends of the tubes and more uniformly distribute the coolant among the tubes, the sacrificial erosion member being positioned within the tank such that the first support member spaces the sacrificial erosion member from the tank and such that the second support member spaces the sacrificial erosion member from the header when assembled with the tank, the first and second support members cooperating to immobilize the sacrificial erosion member within the chamber; and performing a brazing operation in which the tank is brazed to the header, the tubes are brazed to the header, and the sacrificial erosion member is brazed to the tank, so as to form a monolithic heater core.

16. A method as recited in claim 15 further comprising the step of forming the sacrificial erosion member such that the sacrificial erosion member will divert the flow of the coolant into at least two flow paths as the coolant flows into the chamber.

* * * * *